United States Patent [19]

le Faou et al.

[11] Patent Number: 4,468,049

[45] Date of Patent: Aug. 28, 1984

[54] SAFETY SKI BINDING PROVIDED WITH AN ELECTRONIC DEVICE FOR DISPLAYING THE DEGREE OF STIFFNESS OF SKI-BOOT RELEASE

[75] Inventors: Daniel le Faou, Varennes Vauzelles; Henry Menager, Nevers, both of France

[73] Assignee: Ste Look, Nevers, France

[21] Appl. No.: 405,600

[22] Filed: Aug. 5, 1982

[30] Foreign Application Priority Data

Aug. 6, 1981 [FR] France ..... 81 15268

[51] Int. Cl.[3] ..... A63C 9/08

[52] U.S. Cl. ..... 280/634; 7/138; 81/3 R; 200/61.58 R

[58] Field of Search ..... 280/634, 612; 73/862.54, 862.65; 7/138; 81/3 R; 177/137, 139; 200/52 R, 61.58 R

[56] References Cited

U.S. PATENT DOCUMENTS

| | | | |
|---|---|---|---|
| 2,582,886 | 1/1952 | Ruge | 73/862.65 X |
| 2,813,709 | 11/1957 | Brier | 177/137 |
| 3,905,611 | 9/1975 | Sittmann | 280/634 X |
| 3,943,882 | 3/1976 | Sollak et al. | 280/634 X |
| 4,120,197 | 10/1978 | Johansson | 73/862.65 X |
| 4,160,555 | 7/1979 | Salomon | 280/612 |
| 4,397,196 | 8/1983 | Lemelson | 73/862.23 |

FOREIGN PATENT DOCUMENTS

| | | | |
|---|---|---|---|
| 1,454,507 | 8/1966 | France | 280631 |
| 2,449,458 | 10/1982 | France . | |

*Primary Examiner*—Joseph F. Peters, Jr.
*Assistant Examiner*—Michael Mar
*Attorney, Agent, or Firm*—Young & Thompson

[57] ABSTRACT

In addition to a boot-retaining jaw unit controlled by a spring having an adjustable degree of stiffness, the safety ski binding is fitted with a force transducer for detecting the effort exerted by the spring on the jaw unit and delivering a signal which is a function of the effort thus detected to an electronic display device of the digital type. The display device is supplied via a normally-open circuit comprising a manually actuated switch.

3 Claims, 8 Drawing Figures

SAFETY SKI BINDING PROVIDED WITH AN ELECTRONIC DEVICE FOR DISPLAYING THE DEGREE OF STIFFNESS OF SKI-BOOT RELEASE

This invention relates to a safety ski binding provided with a device for displaying the stiffness of ski-boot release.

In ski bindings of known types, the stiffness of release is indicated by a pointer which is displaceable along a graduated scale.

A kinematic connection is established between the pointer and the stiffness adjustment member so as to ensure that the position of the pointer is a function of the degree of compression of the resilient member which exerts an effort for retaining the ski-boot on the ski.

However, the value indicated on the scale is in fact a function, not of the effort actually exerted by the resilient member, but of the deflection of this latter. This gives rise to a difficulty by reason of the inevitable dispersion existing between the characteristics of springs at present in use, the stiffness of which is liable to vary not only from one binding to another but also in the course of time in a given binding.

In order to solve this difficulty, it has already been proposed to calibrate ski bindings during assembly at works. Thus, in accordance with the method described in French Pat. No. 2 449 458 granted to the present Applicant, the reading scale is positioned automatically on the ski-binding body at a location which depends on the stiffness of the spring employed. Unfortunately, in spite of its relative simplicity, this calibrating operation calls for an additional station in the assembly line and this has the effect of increasing the cost price of the ski binding. Furthermore, this method does not provide any solution to the problem presented by slackening of the resilient member in the course of time.

Finally, another disadvantage of mechanical indicating devices in current use is the lack of accuracy in reading. This deficiency is encountered in particular in some types of safety mechanisms in which an extensive range of stiffness is covered by a relatively short distance of travel of the adjustment member. It has been proposed to mount a mechanical reduction-gear system between the adjustment member and the indicating pointer but this solution is equally unsatisfactory since it entails the use of additional components which are relatively cumbersome as well as costly and unreliable.

The invention proposes to overcome these disadvantages.

To this end, the safety ski binding according to the invention comprises at least one ski-boot retaining member controlled by a resilient member having an adjustable degree of stiffness. The ski binding essentially comprises a force transducer adapted to detect the stiffness of said resilient member and to deliver to an electronic display device a signal which is a function of the stiffness detected.

The display device is preferably of the digital type and is advantageously mounted in a stationarily fixed position on the ski binding.

Provision can be made for a display-device control circuit which is normally open and comprises a switch which is accessible from the exterior and can be actuated so as to close the control circuit. In this case it is an advantage to arrange said switch so as to ensure that it is automatically actuated as a result of the presence of a suitable adjusting tool which is in contact with the stiffness adjustment member.

Other features of the invention will be more apparent to those skilled in the art upon consideration of the following description and accompanying drawings, wherein.

Figure 1:
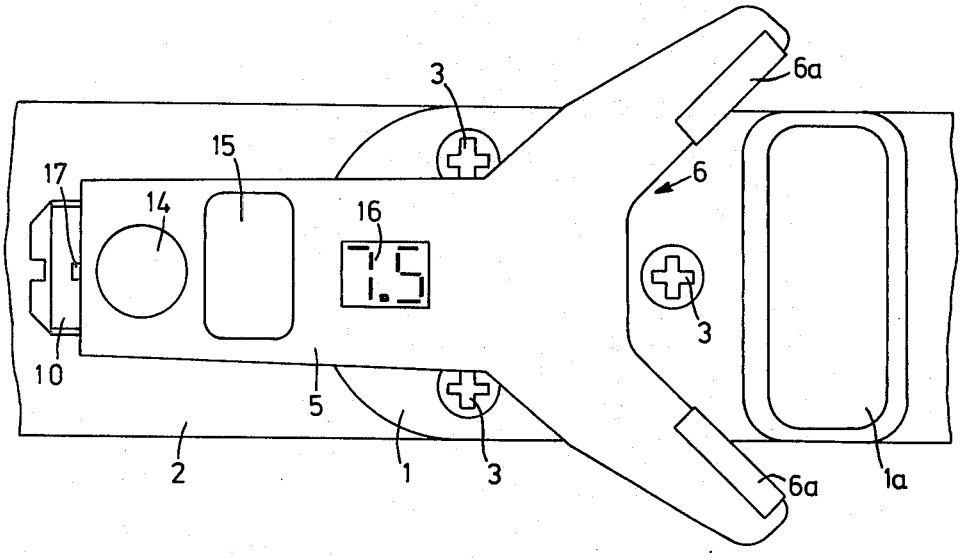
FIG. 1 is an overhead view of a first embodiment of a safety ski binding according to the invention.
Figure 2:
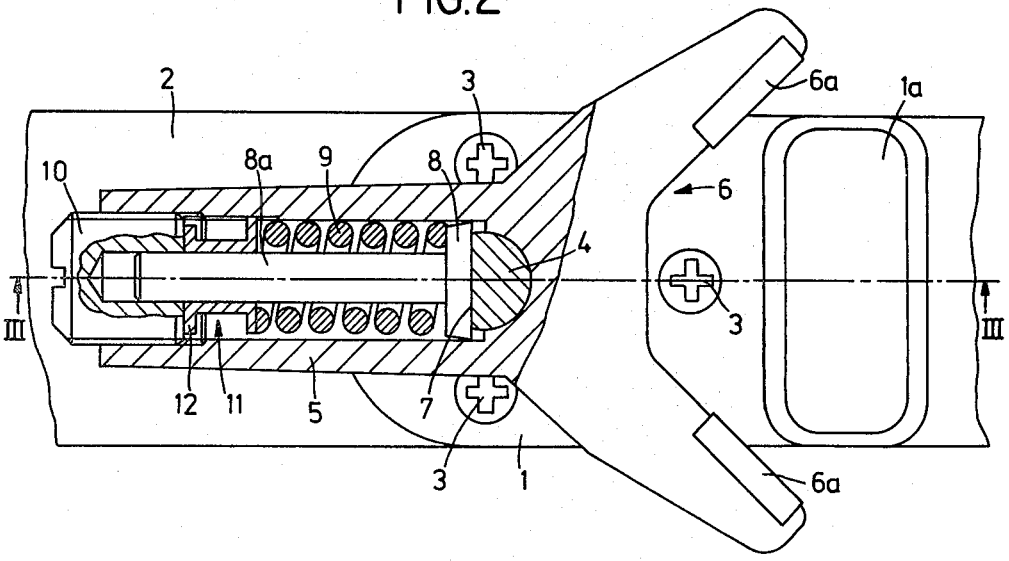
FIG. 2 is an overhead view of the ski binding of FIG. 1, this view being taken partly in section along the horizontal plane II—II of FIG. 3.
Figure 3:
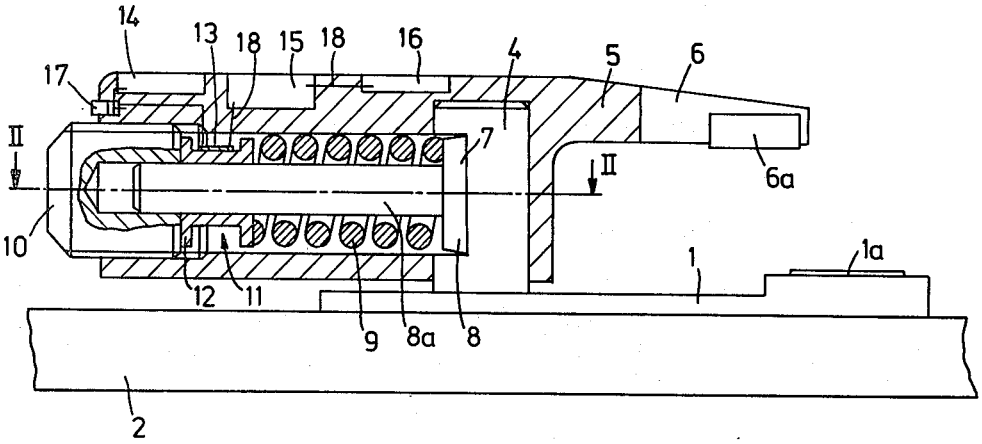
FIG. 3 is a view in side elevation and in section along the plane III—III of FIG. 2.

The first embodiment shown in FIGS. 1 to 3 represents a toe-abutment unit which is intended to co-operate in a well-known manner with the front portion or toe end of the ski boot. Said toe-abutment unit comprises a base plate 1 which is attached to the ski 2 by means of screws 3. The plate 1 is provided with a vertical pivot 4, a body 5 being rotatably mounted on said pivot and adapted to carry the boot-retaining jaw 6 (not shown in the drawings). The base plate 1 and the jaw 6 are provided with antifriction elements which are designated respectively by the references 1*a* and 6*a* and against which the ski boot is intended to come into contact.

In accordance with well-known practice, the pivot 4 has a flat vertical bearing face 7 which is directed towards the front end of the ski. A piston 8 is slidably mounted within a bore of the toe-abutment body 5 and resiliently applied against the aforesaid flat bearing face of the pivot. The piston 8 is actuated by a spring 9, the compression of which can be modified by rotational displacement of a threaded end-cap 10 which is screwed into the toe-abutment body 5. The stiffness of release of the toe-abutment unit is a function of the compression of the spring 9. It will be noted that the piston 8 has a cylindrical rod 8*a* which serves to guide it within a bore of the end-cap 10.

Figure 4:
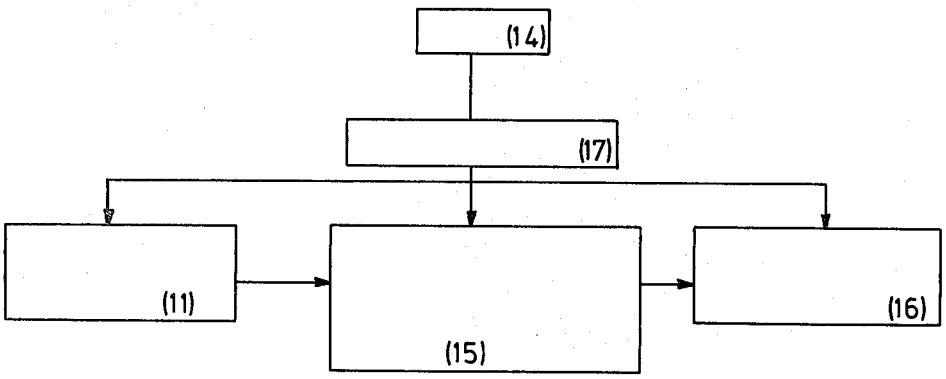
FIG. 4 is a diagram showing the operation of the device according to the invention.

In accordance with the invention, the toe-abutment unit comprises a force transducer 11. This transducer is constituted by a cylindrical sleeve 12 through which the rod 8*a* is adapted to pass, said sleeve being provided with two end flanges which serve to apply said rod at one end against the spring 9 and at the other end against the adjustment end-cap 10. It is apparent that the sleeve 12, which is urged in the axial direction by the spring 9, is subjected to a stress which is a function of the load applied to said spring and therefore of the stiffness of release of the toe-abutment unit. On the sleeve 12 are mounted one or a number of strain gages 13. By way of example, provision can be made for four gages connected as a Wheatstone bridge or for two gages connected as a half-bridge. On the toe-abutment body 5 are mounted a supply unit consisting of a dry-cell battery 14, an electronic circuit 15 constituted by an amplifier and by an analog-to-digital converter, a digital display device 16 and a switch 17. These different elements are associated with each other by means of electrical connections 18 in accordance with the diagram of FIG. 4. The dry-cell battery 14 is connected via the switch 17 to the force transducer 11, to the electronic circuit 15 and to the digital display device 16. The switch 17 is normally open, with the result that the components 11, 15 and 16 are not normally supplied with current.

When the operator, retail dealer or skier desires to carry out or check the adjustment of the ski binding, he simply depresses the switch 17. The force transducer 11 then delivers to the circuit 15 a signal which is a function of the degree of compression of the spring 9 and correlatively of the stiffness of release of the toe abutment unit. After amplification and conversion to a digital signal, said signal is indicated on the digital display device 16. Preliminary calibration of the circuit 15 permits display of the applied torque which has the effect of releasing the ski boot from the ski binding. Thus the value of 7.5 indicated in FIG. 1 by way of example corresponds to a boot-release torque of 7.5 daNxm. It is apparent that a different quantity could be displayed by modifying the calibration of the circuit and could accordingly be the release torque applied at the toe end of the ski boot (and expressed in daN). The display device is preferably of the liquid-crystal type or of the electroluminescent-diode type.

By producing a rotational displacement of the threaded end-cap 10 by means of a screwdriver, the operator can modify the stiffness of release of the toe abutment member until the value read on the display device 16 corresponds to the value which is prescribed by the table of adjustment (provided with the ski-binding) and which depends on the characteristics of the skier (weight, sex, proficiency, and so on).

When a good adjustment has been obtained, the operator releases the switch 17, thus interrupting the supply of current to the elements 11, 15, 16. This arrangement serves to prevent continuous power consumption which would serve no useful purpose and would result in excessive deterioration of the dry-cell battery 14.

Figure 5:
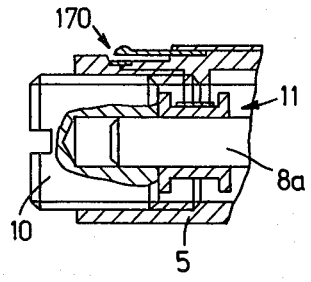
FIG. 5 is a detail showing a ski binding which is similar to the binding of FIGS. 1 to 3 but is equipped with a different type of switch.
Figure 6:
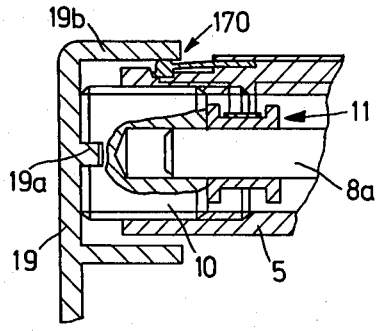
FIG. 6 is similar to FIG. 5 but shows a suitable adjusting tool which is engaged against the stiffness adjustment member.

FIG. 5 shows a switch 170 which, in contrast to the switch 17 of FIG. 3, is not located on the front portion of the toe-abutment body 5 but on the top face of this latter. In this case, the switch consists of a circuit closer of the resilient-strip type. FIG. 6 shows an adjusting tool 19 having a central lug 19*a* adapted to penetrate into the slot of the adjustment end-cap 10 and having an annular portion 19*b* adapted to initiate closure of the switch 170 during the adjusting operation. Thus the switch is actuated automatically as a result of the presence of the adjusting tool. Conversely, when the adjustment has been completed, withdrawal of the tool initiates opening of the switch and therefore disconnects the circuit from the source of supply.

Figure 7:
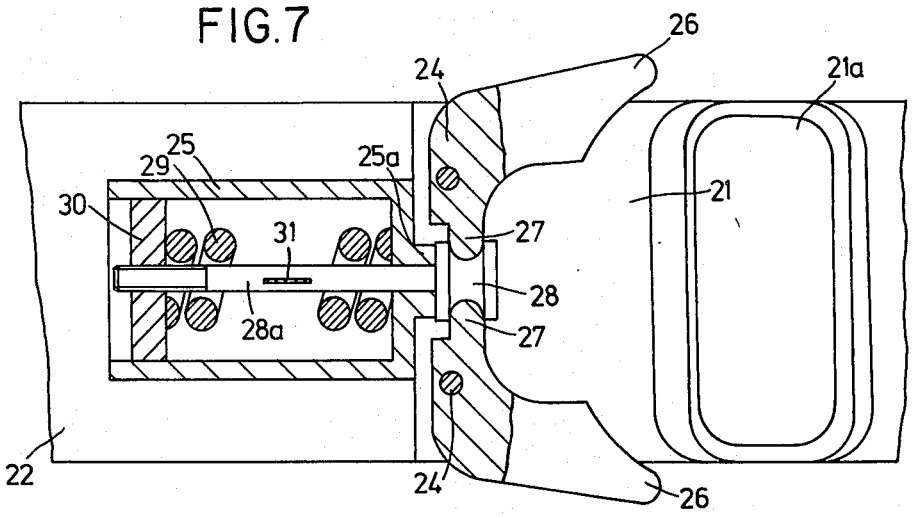
FIGS. 7 and 8 are overhead views, partly in section along a horizontal plane, showing respectively a second and a third embodiment of a ski binding according to the invention.

FIG. 7 illustrates a toe-abutment member which is also of known type and comprises a jaw unit constituted by two separate and independent arms 26, each arm being capable of pivotal displacement about a vertical pin 24.

Each arm 26 is provided with an extension or appendage 27 engaged in a groove formed in the head 28 of a tie-rod 28*a*. The front end of the tie-rod 28*a* is threaded and adapted to carry an adjusting nut 30. A spring 29 housed within the stationary ski-binding body 25 produces action on the nut 30 in order to exert a tractive force on the tie-rod 28*a* and correlatively on the arms 26 in the boot-retaining position. In this position, the head 28 is applied against an annular flange 25*a* formed on the rear face of the ski-binding body 25. In accordance with the invention, said toe-abutment member is provided with a force transducer consisting of a strain gage 31 which is bonded directly to the tie-rod 28*a*. The gage 31 delivers a signal which is a function of the degree of compression of the spring 29 to an electronic display device (not shown) after amplification and analog-to-digital conversion as in the first embodiment. The use of a plurality of strain gages 31 mounted in a bridge arrangement may clearly be contemplated. This makes it possible in particular to obtain a signal which is independent of the temperature.

Figure 8:
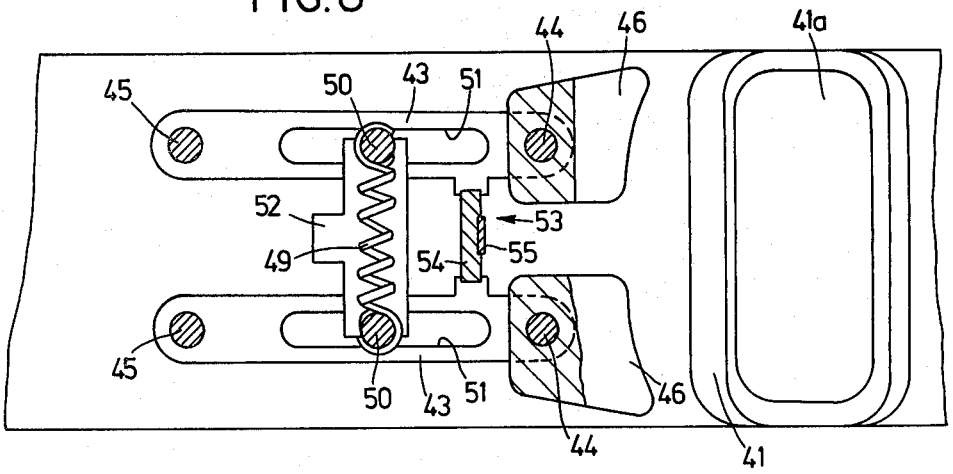

The toe-abutment member which is illustrated in FIG. 8 and is also of known type comprises two jaws 46. Said jaws are pivotally mounted so as to be capable of rotating freely about vertical pins 44, these pivot-pins being mounted at the end of a pair of levers 43 arranged parallel to the axis of the ski. The levers 43 are in turn pivotally mounted on stationary vertical pins 45.

The ends of a transverse tension spring 49 are attached to vertical rods 50 extending through elongated slots 51 formed in the levers 43. The rods 50 are engaged in lateral recesses of a central member 52 which is capable of sliding along the axis of the ski. In accordance with the invention, the toe-abutment member is provided with a force transducer 53 comprising a small plate 54 disposed between the two levers 43 and serving as a stop for these latter. A strain gage 55 is bonded to the small plate 54.

The position of the member 52 and of the spring 49 carried by this latter can be modified at will by making use of adjusting means (not shown in the drawings for the sake of enhanced simplicity) since the rods 50 are capable of displacement within the elongated slots 51. In consequence, the moment corresponding to the stiffness of ski-binding release and applied by the spring 49 on each lever 43 can consequently be modified. In point of fact, since the levers 43 are applied against the small plate 54, the compressive stress sustained by said plate is proportional to the moment applied by the spring 49 on the levers 43. The strain gage 55 delivers a signal which is proportional to said stress and transmitted to the digital display device (not shown) after processing.

Although the invention has been applied to toe-abutment members in the examples described in the foregoing, it will be readily apparent that the invention is equally applicable to heel-holding members or to locking mechanisms for sole-plates.

The circuit for processing the signal delivered by the force transducer, the electronic display device and the dry-cell battery are not necessarily fixed on the ski-binding in a permanent manner but may be independent and connected to the transducer solely at the moment of adjustment of the binding. These elements, or only a certain number of elements, could in particular be carried by the stiffness-adjusting tool.

What is claimed is:

1. A safety ski binding comprising at least one ski-boot retaining member controlled by a resilient member having an adjustable degree of stiffness, wherein:

said ski binding comprises a force transducer adapted to detect the effort exerted by said resilient member on said retaining member and to deliver a signal which is a function of the effort detected to an electronic display device, the display device having a normally-open supply circuit which comprises a switch which is accessible from the exterior of the ski binding and can be actuated so as to supply current to said display device, said switch being so arranged as to be automatically actuated as a result of positioning of a tool of suitable shape which serves to adjust the stiffness of the resilient member.

2. A safety ski binding according to claim 1, wherein the display device is of the digital type.

3. A safety ski binding according to claim 1, wherein the display device is mounted in a stationarily fixed position on the ski binding.

* * * * *